US008485079B2

(12) United States Patent
Chiang

(10) Patent No.: US 8,485,079 B2
(45) Date of Patent: Jul. 16, 2013

(54) ANGLE CUTTING MACHINE WITH EXCHANGEABLE CUTTING MEMBERS

(75) Inventor: Chou-Chih Chiang, Taichung (TW)

(73) Assignee: Chung Sheen Technology Co., Ltd, Taichung (TW)

( * ) Notice: Subject to any disclaimer, the term of this patent is extended or adjusted under 35 U.S.C. 154(b) by 438 days.

(21) Appl. No.: 12/915,191

(22) Filed: Oct. 29, 2010

(65) Prior Publication Data

US 2012/0103157 A1 May 3, 2012

(51) Int. Cl.
*B26D 5/02* (2006.01)
*B26D 3/10* (2006.01)

(52) U.S. Cl.
USPC ..... 83/553; 83/618

(58) Field of Classification Search
USPC ..... 83/553, 618, 549, 167, 162; 30/113.1, 30/114; 606/79, 167, 96, 99, 170, 179, 180; 424/422
See application file for complete search history.

(56) References Cited

U.S. PATENT DOCUMENTS 1,544,393 A * 6/1925 Hatcher et al. ..... 29/251
1,932,922 A * 10/1933 Brown ..... 83/553
3,943,744 A * 3/1976 Marsh et al. ..... 72/326
4,151,768 A * 5/1979 Shockovsky ..... 83/33

* cited by examiner

*Primary Examiner* — Ghassem Alie
(74) *Attorney, Agent, or Firm* — Chun-Ming Shih

(57) ABSTRACT

An angle cutting machine with exchangeable cutting members includes a base portion, an adjusting device, a cutting device, a powering device and a positioning device. The adjusting device includes a base board, an adjusting portion and a position limiting portion. An adjusting area and a position limiting area are formed in the base board. The cutting device has a vertical axle and a plurality of cutting members. The powering device can provide power to the vertical axle so that the vertical axle can carry out a reciprocating up-down motion. The positioning device moves along with the cutting device to ensure the correct positioning of the cutting device. Therefore, the cutting members may be fitted to the main body more accurately and more easily and safety in the use of the cutting machine may be enhanced.

9 Claims, 15 Drawing Sheets

ANGLE CUTTING MACHINE WITH EXCHANGEABLE CUTTING MEMBERS

BACKGROUND OF THE INVENTION

1. Field of the Invention

The invention generally relates to a paper cutting machine. More particularly, the invention relates to an angle cutting machine in which a cutting member may be easily switched by another cutting member with a different size and shape.

2. Description of the Prior Art

In many cases, there is a need to round up the angles of paper by using an angle cutting machine to carry out such arc-shaped or linear cut.

There have been two types of angle cutting machine: cutting machine with a single cutting member and cutting machine with several cutting members. To have different arc-shaped cuts and different sloped cuts, different cutting members are needed to replace the single cutting member. Such replacement is time-consuming and affects the efficiency in operation.

With regard to the cutting machine with several cutting members, when a cutting member is switched by another one, such switch is done manually and the positioning of another cutting member is usually inaccurate. Some of such cutting machines have mechanical positioning design. However, long-term wear and tear would result in the misalignment and hence the inaccuracy in cutting. Moreover, such inaccurate alignment and positioning would cause bodily injuries to a user when he carries out the cutting operation.

SUMMARY OF THE INVENTION

An object of the present invention is to provide an angle cutting machine in which the cutting members may be fitted to the main body more accurately.

Another object of the present invention is to provide an angle cutting machine that is safer to use.

To reach these objects, the angle cutting machine with exchangeable cutting members of the present invention is disclosed. The angle cutting machine of the present invention comprises a base portion, an adjusting device, a cutting device, a powering device and a positioning device.

The base portion may stably rest on a flat surface.

The adjusting device is disposed on the base portion and comprises a base board, an adjusting portion and a position limiting portion. The base board is fixedly disposed on the base portion and an adjusting area and a position limiting area are formed in the base board. The position limiting area is in communication with the adjusting area. The adjusting portion is disposed in the adjusting area and can spin around. Each of the exterior walls of the adjusting portion has a different inclination or arc shape. Several position limiting slots are formed between each pair of the exterior walls. The position limiting slots and the exterior walls are arranged in an alternating manner. The position limiting portion is disposed in the position limiting area and can spin around. A position limiting protrusion is provided on the position limiting portion. As the position limiting protrusion enters the position limiting slot, the adjusting portion would not be able to rotate.

The cutting device has a vertical axle and a plurality of cutting members. The vertical axle can carry out a reciprocating up-down motion and spin. The cutting members circumferentially encircle the cutting device.

The powering device is disposed on the base portion. The powering device can provide power to the vertical axle so that the vertical axle can carry out a reciprocating up-down motion.

The positioning device moves along with the cutting device to ensure the correct positioning of the cutting device.

BRIEF DESCRIPTION OF THE DRAWINGS

The drawings disclose an illustrative embodiment of the present invention which serves to exemplify the various advantages and objects hereof, and are as follows.

DETAILED DESCRIPTION OF THE PREFERRED EMBODIMENT

Figure 1:
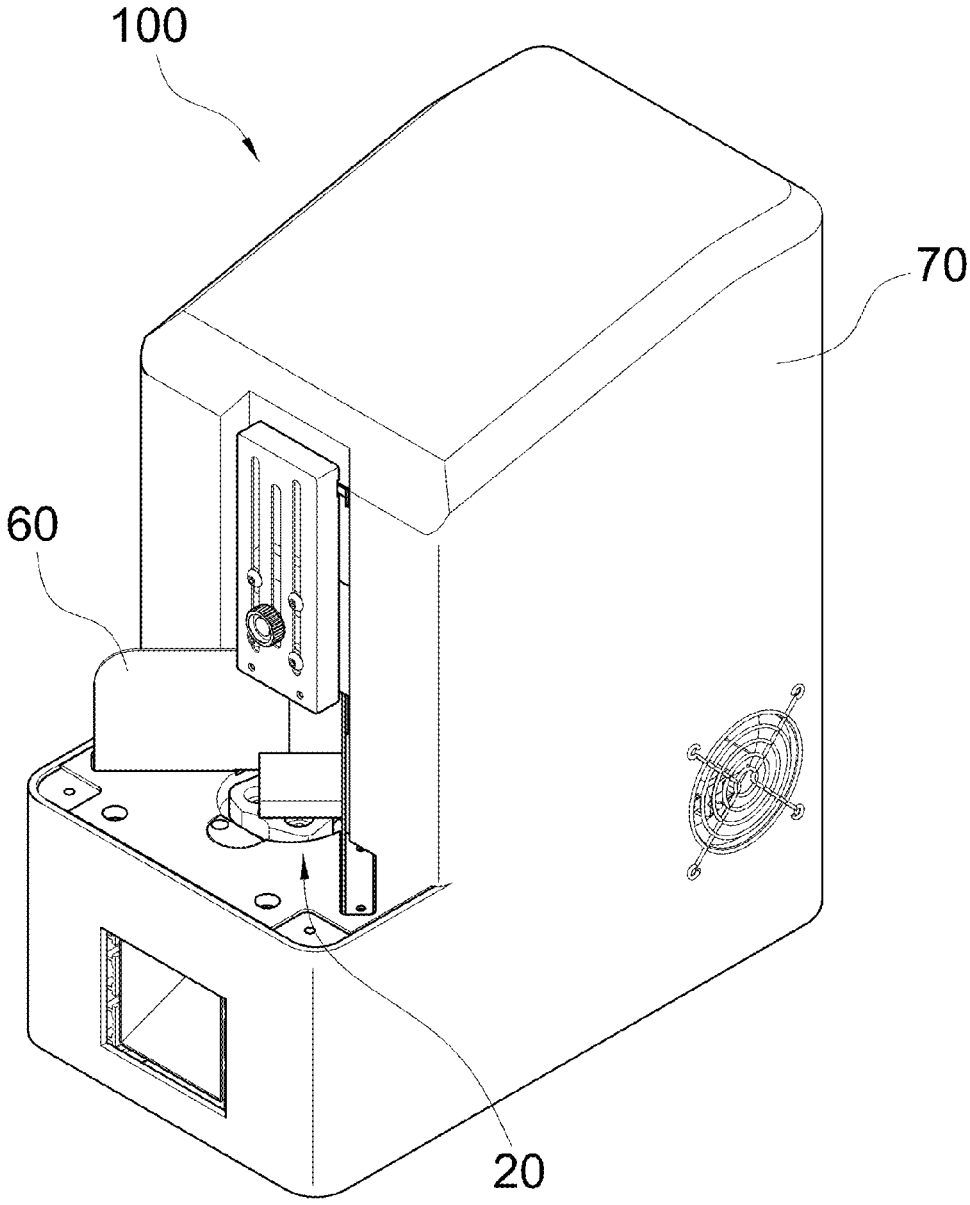
FIG. 1 is a perspective view showing an embodiment of the present invention in an assembled condition.

Please see FIGS. 1 to 16. The angle cutting machine 100 of the present invention comprises a base portion 10, an adjusting device 20, a powering device 30, a cutting device 40, a positioning device 50, a protecting device 60 and a casing 70.

Please refer to FIGS. 1 to 4. The base portion 10 may be stably placed on a flat surface (such as a floor).

Please refer to FIGS. 1 to 6. The adjusting device 20 comprises a base board 21, an adjusting portion 22, a position limiting portion 23 and a resistance unit 24. The base board 21 is fixedly disposed on the base portion 10. An adjusting area 211 and a position limiting area 212 are formed in the base board 21. The adjusting area 211 is in communication with the position limiting area 212. An opening 213 is formed on one side of the base board 21 and is in communication with the adjusting area 211. The adjusting portion 22 is disposed in the adjusting area 211 and can spin around. Each of the exterior walls 221 of the adjusting portion 22 has a different inclination or arc shape. Several position limiting slots 222 are formed between each pair of the exterior walls 221 and the position limiting slots 222 and the exterior walls are arranged in an alternating manner. The position limiting portion 23 is disposed in the position limiting area 212 and can spin around. A position limiting protrusion 231 is provided on the position limiting portion 23. The resistance unit 24 is fitted to the underside of the base board 21 and is connected with the adjusting portion 22 and the position limiting portion 23 so as to provide an appropriate amount of resistance to the adjusting portion 22 and the position limiting portion 23.

Please see FIGS. 1 to 4. The powering device 30 can impart a linear motion. Please refer to FIGS. 1 to 6. The cutting device 40 has a vertical axle 41 and a plurality of cutting members 42. The vertical axle 41 is disposed on the base portion 10 and is connected with the powering device 30 so that the vertical axle 41 can carry out a reciprocating up-down motion through the power provided by the powering device 30. The vertical axle 41 can spin around its central axis through the power provided by the powering device 30 or through an external force. The cutting members 42 circumferentially encircle the cutting device 40. Each of the cutting members 42 has a different inclination or arc shape that matches the corresponding exterior wall 221.

Figure 9:
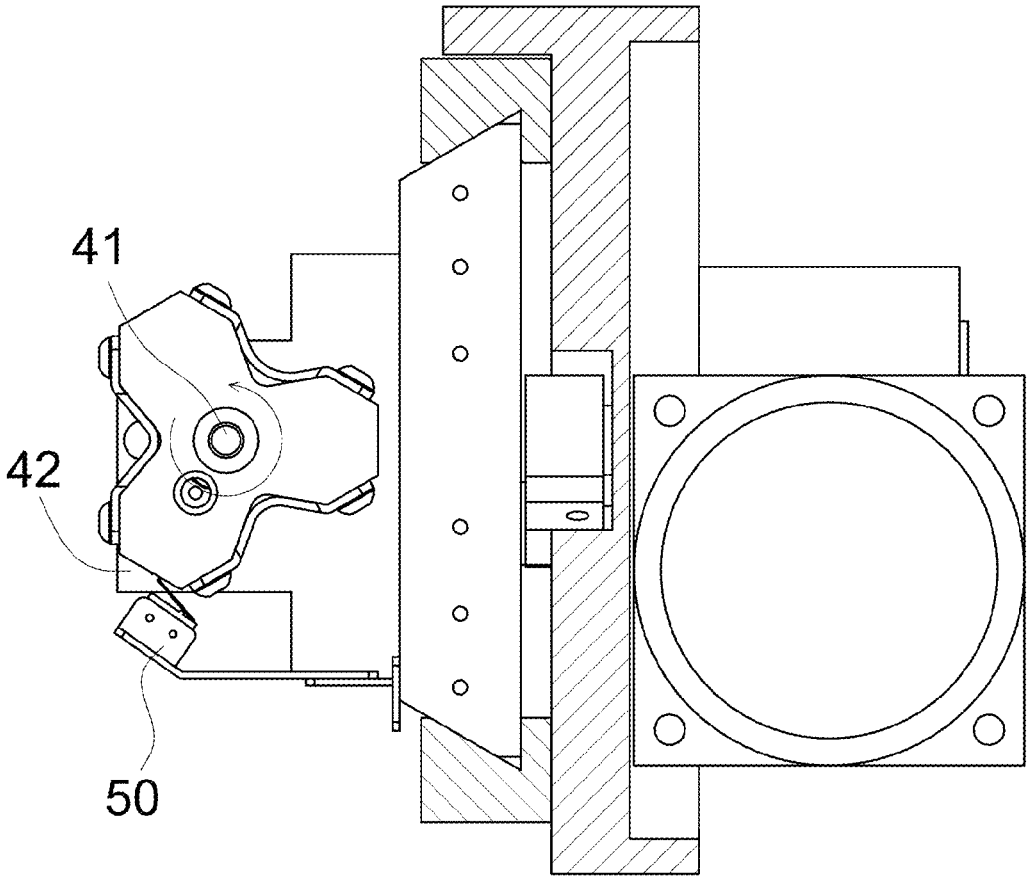
FIG. 9 is another cross-sectional view showing how the cutting member of the embodiment of FIG. 1 is switched to another cutting member.

Please refer to FIGS. 1 to 6. The positioning device 50 comprises a plurality of touch switches, whose quantity is equal to that of the cutting members 42. The touch switches are disposed on the base portion 10 (as shown in FIG. 9).

Figure 2:
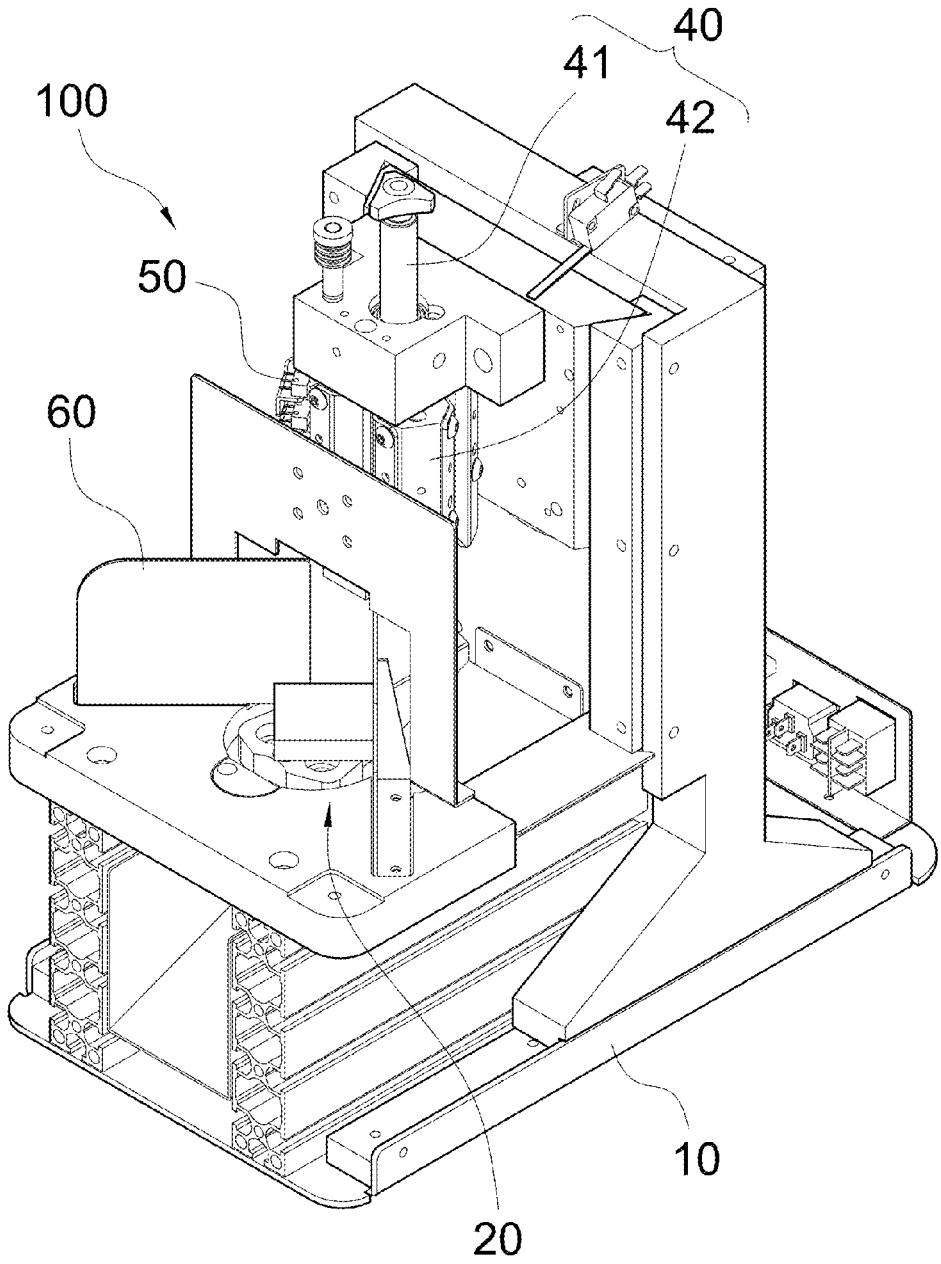
FIG. 2 is a perspective view showing the embodiment of FIG. 1 in an assembled condition with the casing removed.
Figure 3:
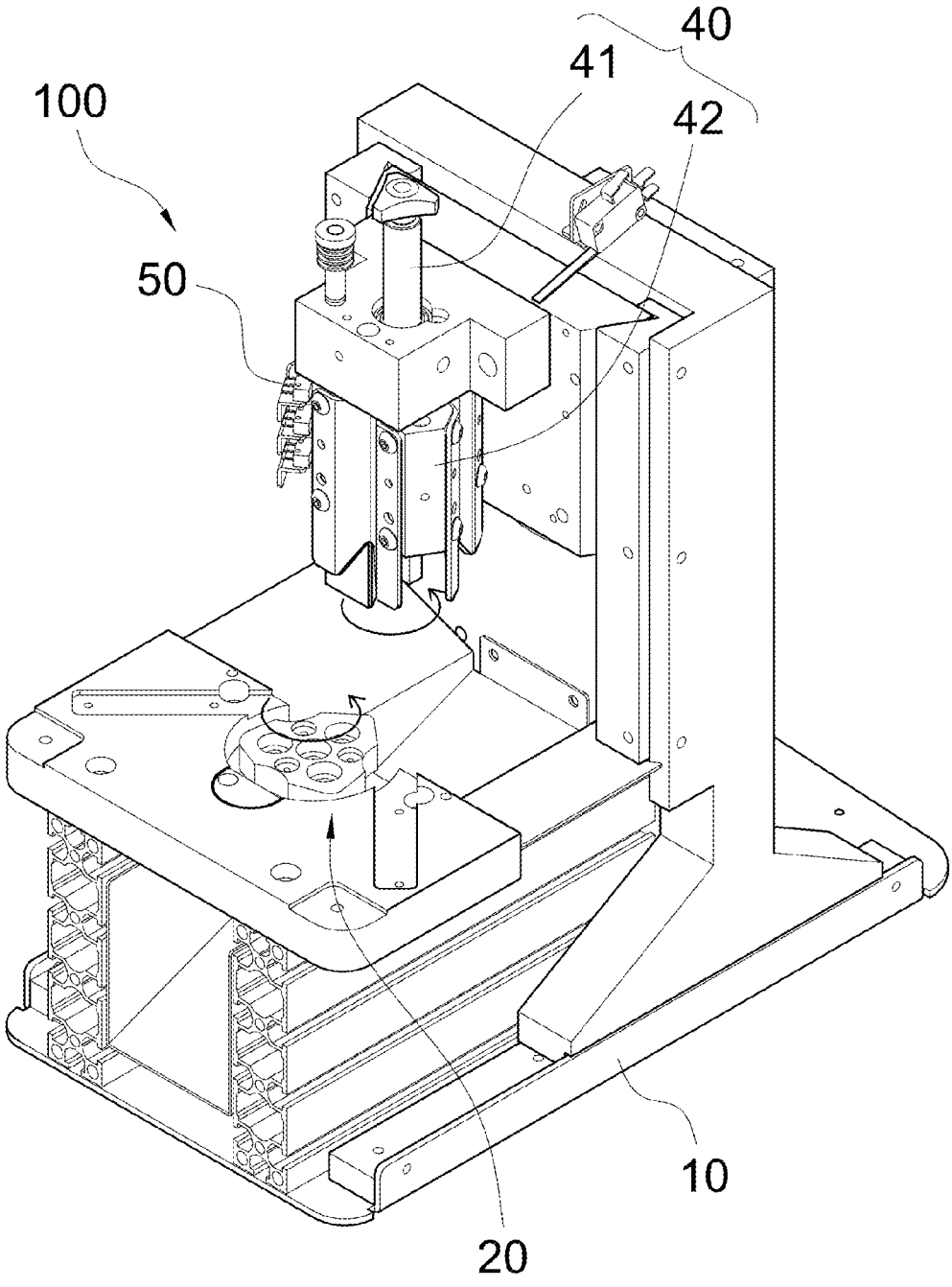
FIG. 3 is a perspective view showing the embodiment of FIG. 1 in an assembled condition with the casing and the protecting device removed.
Figure 4:
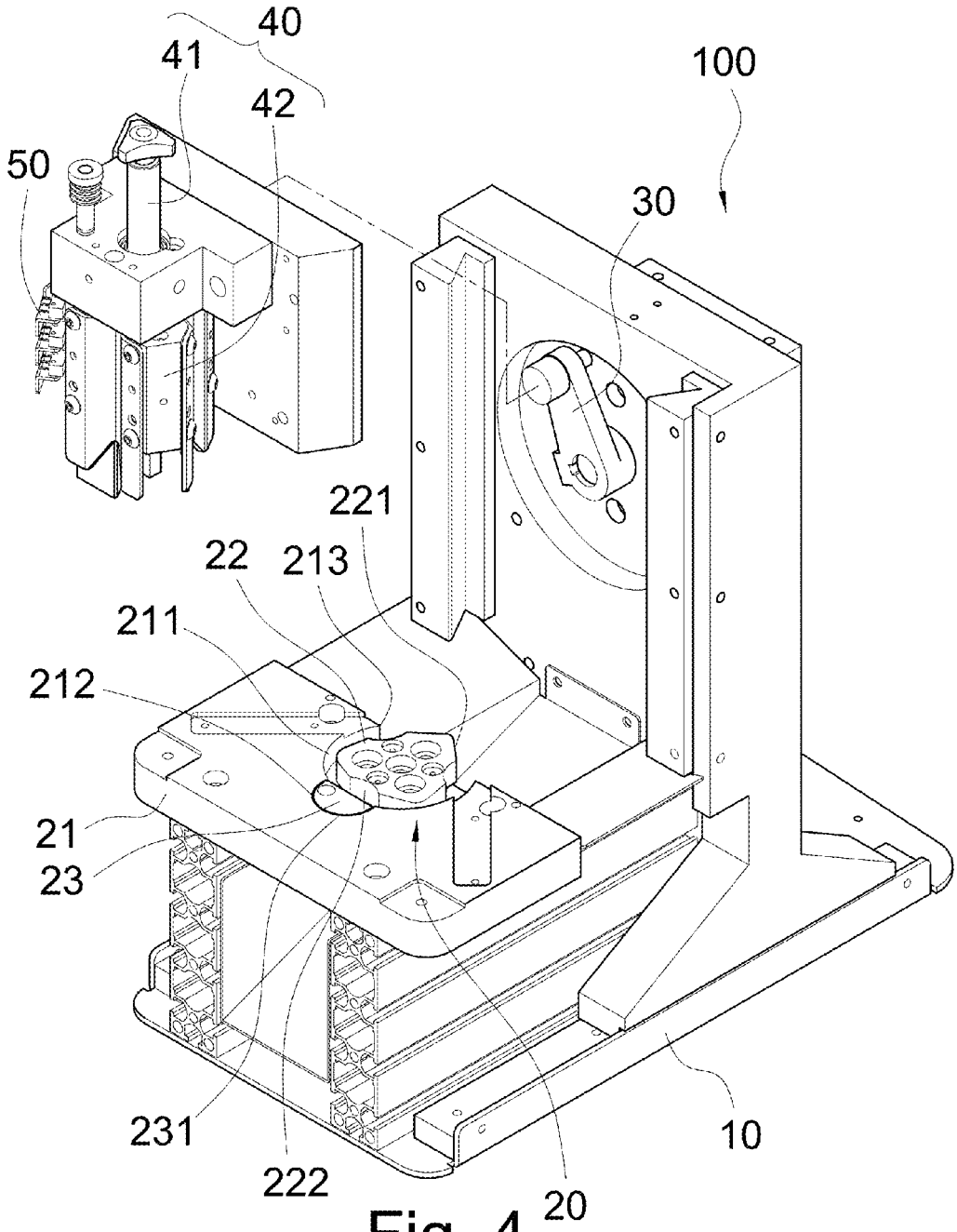
FIG. 4 is a perspective view showing the embodiment of FIG. 1 with the cutting device and the positioning device detached.
Figure 5:
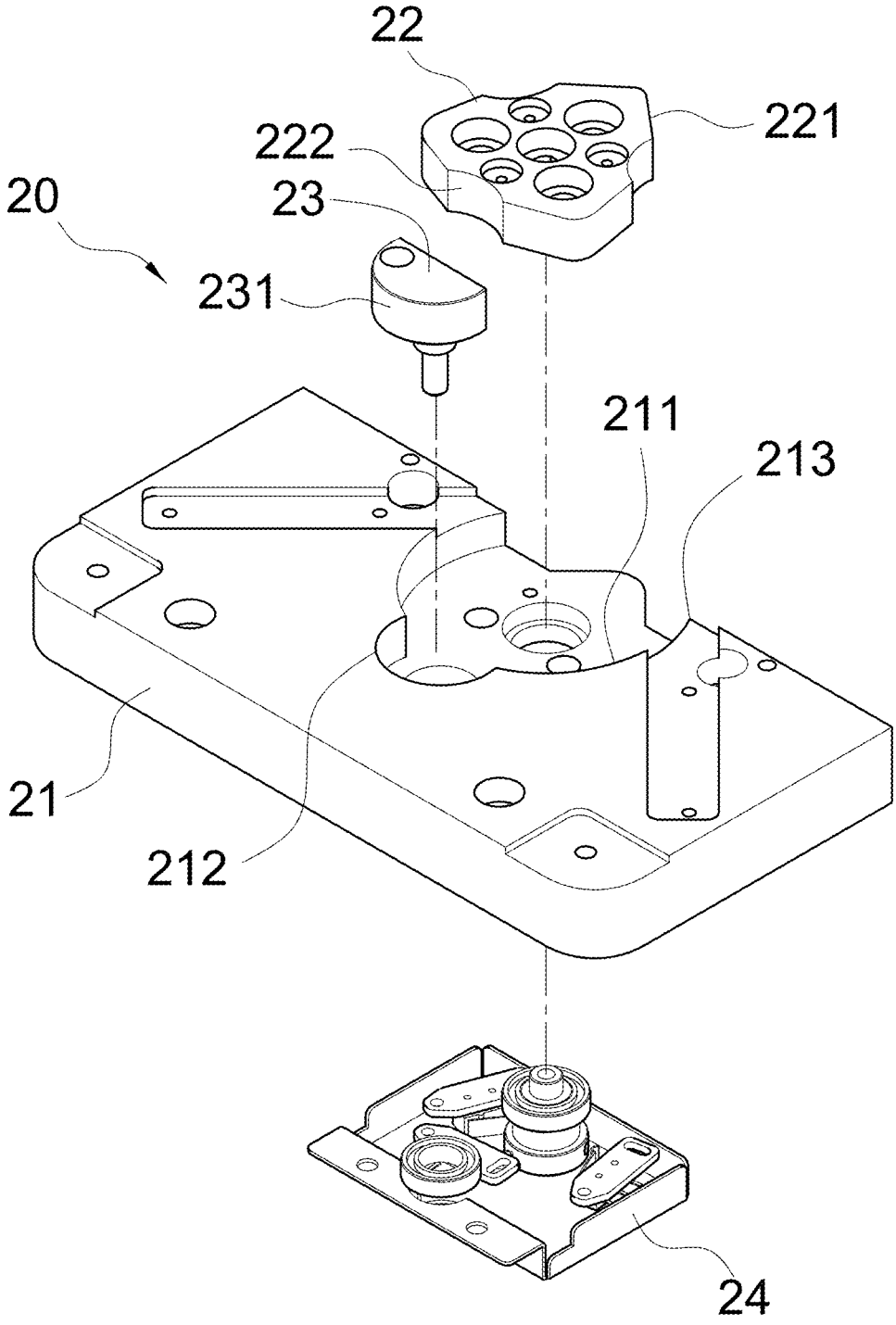
FIG. 5 is an exploded view showing some parts of the embodiment of FIG. 1.
Figure 6:
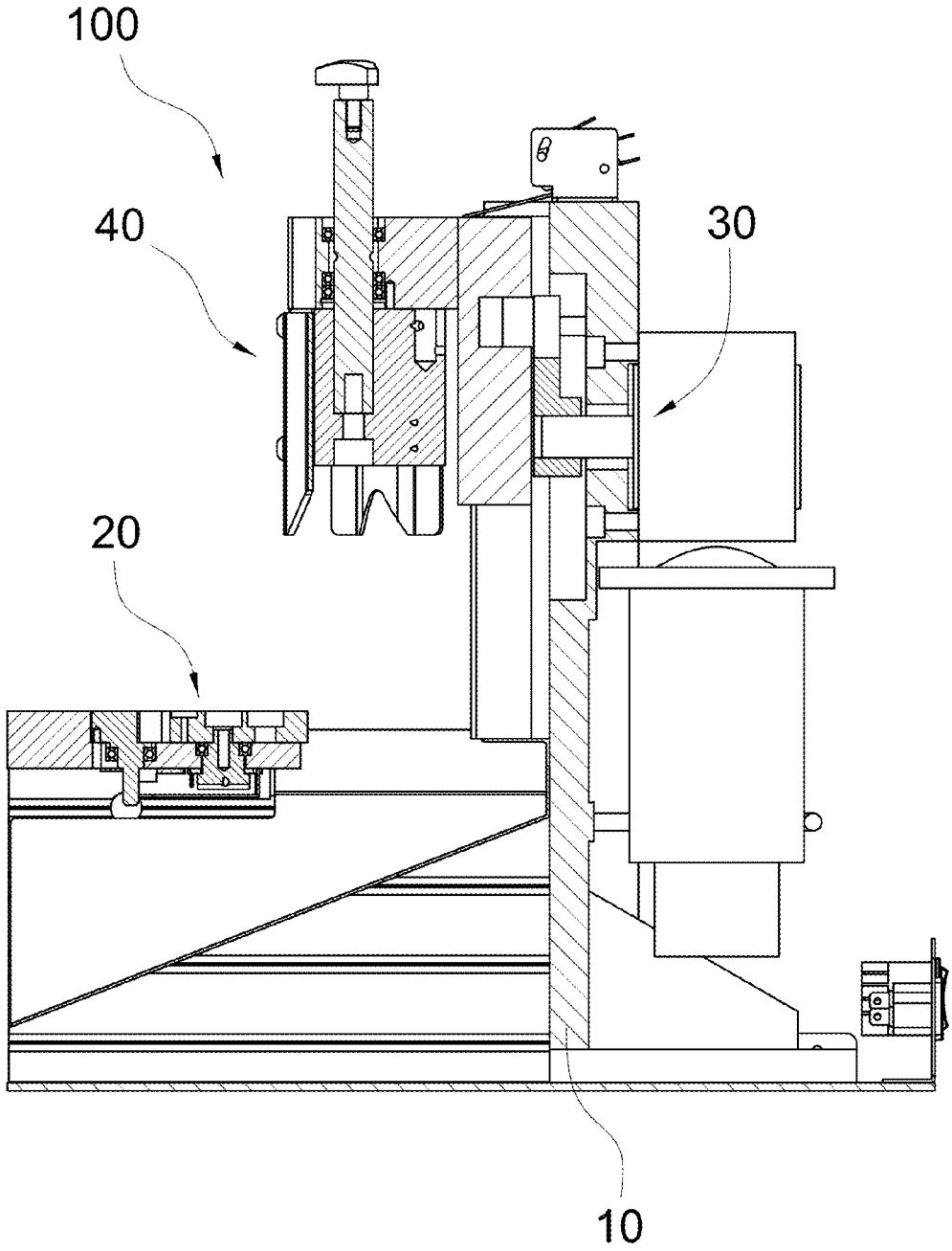
FIG. 6 is a sectional view showing the embodiment of FIG. 1.

Please see FIGS. 1 and 2. The protecting device 60 comprises several boards, which are provided on the base portion 10, to prevent accidental contact between a user's body and the cutting device 40.

Please see FIG. 1. The casing 70 is disposed on the base portion 10.

We will elaborate on how the angle cutting machine 100 of the present invention is used in the following.

Figure 7:
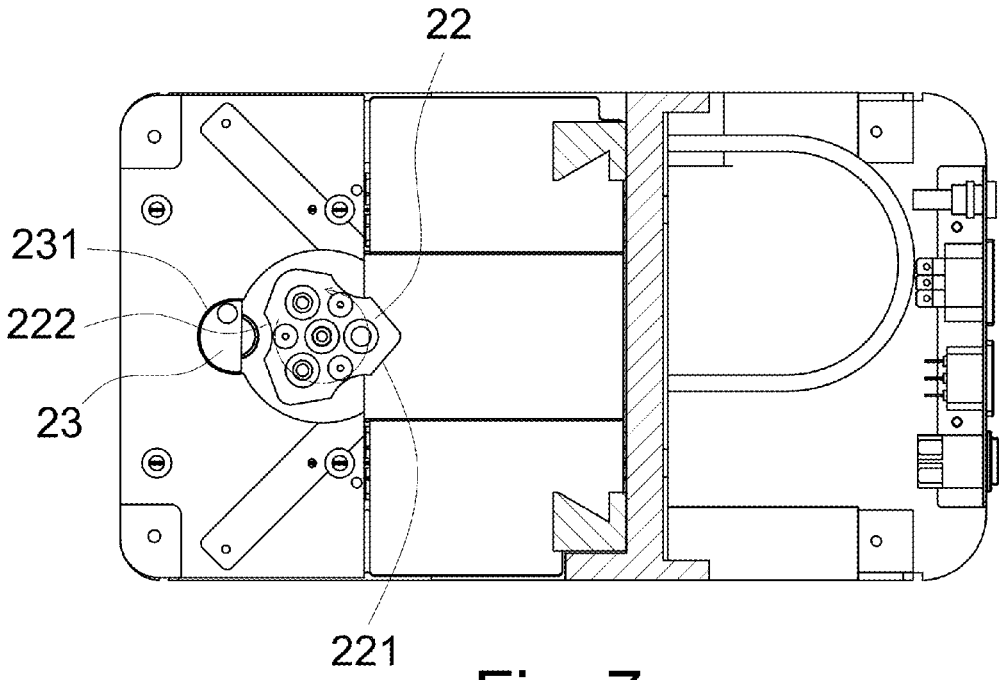
FIG. 7 is a cross-sectional view showing how a cutting member of the embodiment of FIG. 1 is switched to another cutting member.
Figure 8:
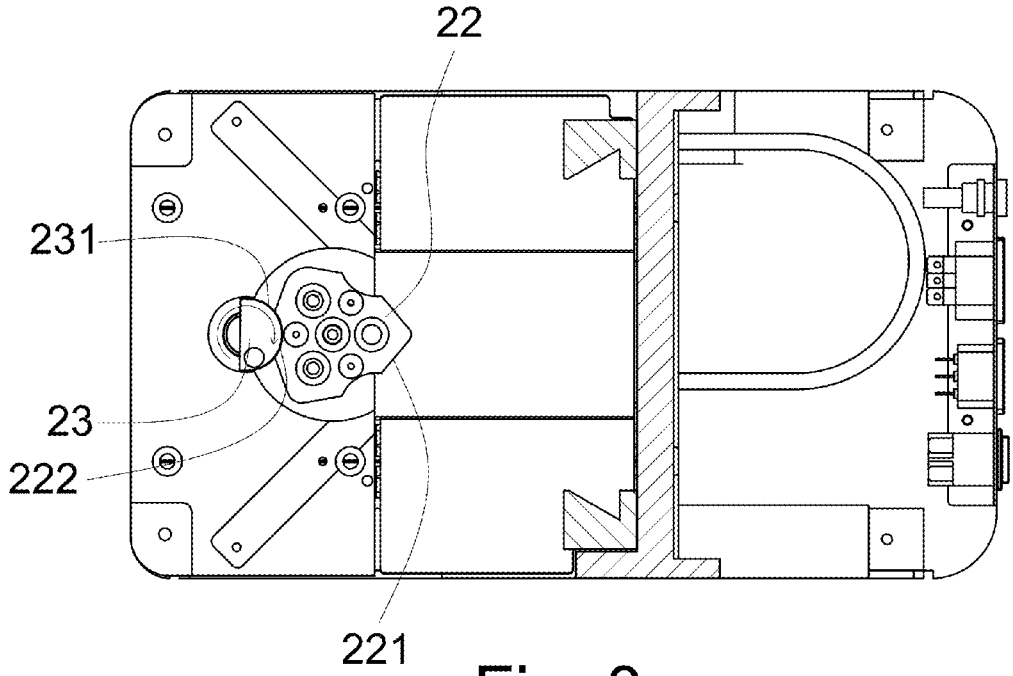
FIG. 8 is a cross-sectional view showing how the cutting member of the embodiment of FIG. 1 is switched to another cutting member.

To switch to another cutting member 42, first rotate the adjusting portion 22 until an appropriate one of the exterior walls 221 is lined up with the opening 213 (as shown in FIG. 7). Next, rotate the position limiting protrusion 231 of the position limiting portion 23 until it engages with the position limiting slot 222 of the adjusting portion 22 (as shown in FIG. 8). Now, the adjusting portion 22 is not able to rotate.

Figure 10:
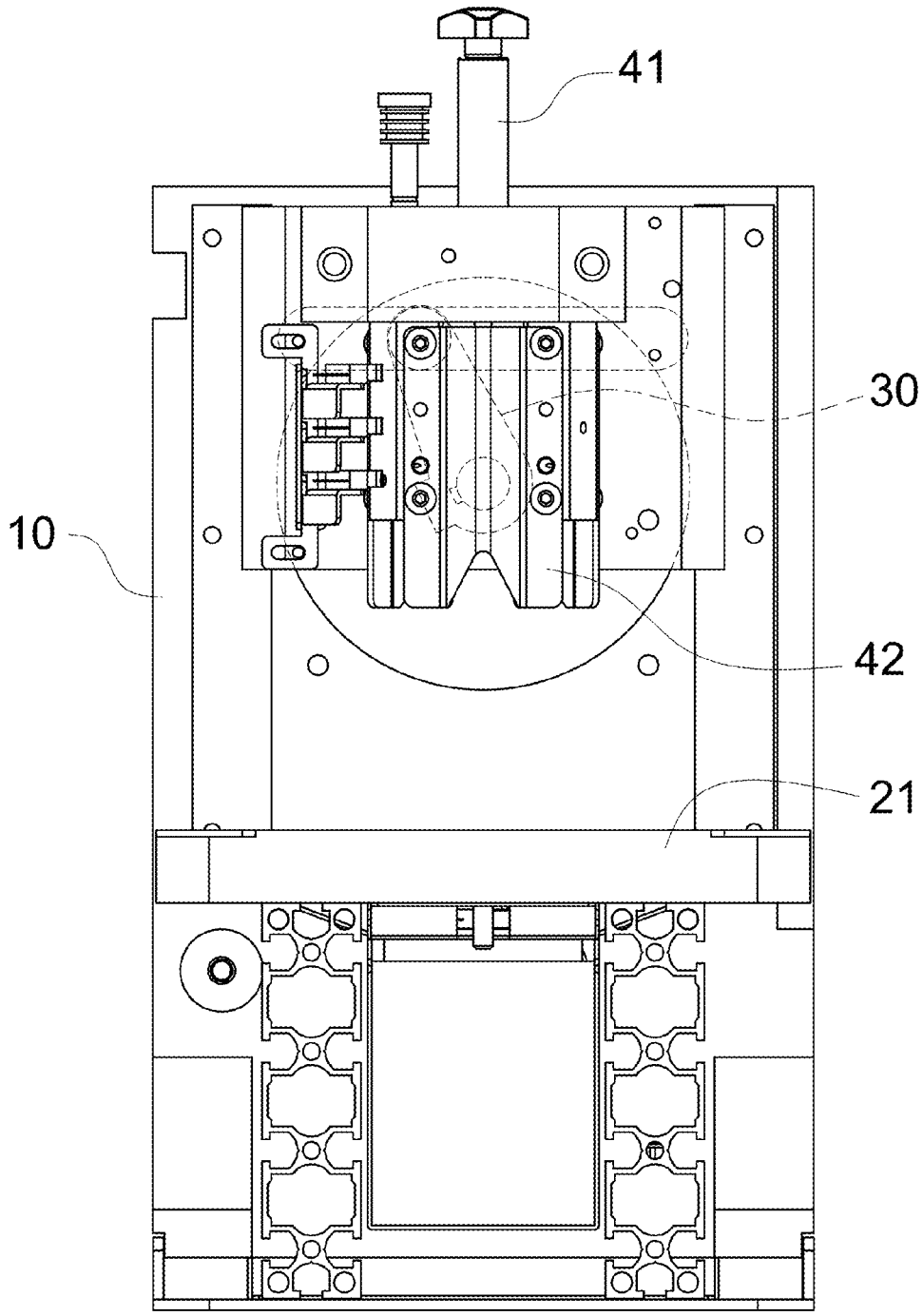
FIG. 10 is a sectional view showing how the powering device provides power to the cutting member in the embodiment of FIG. 1.
Figure 11:
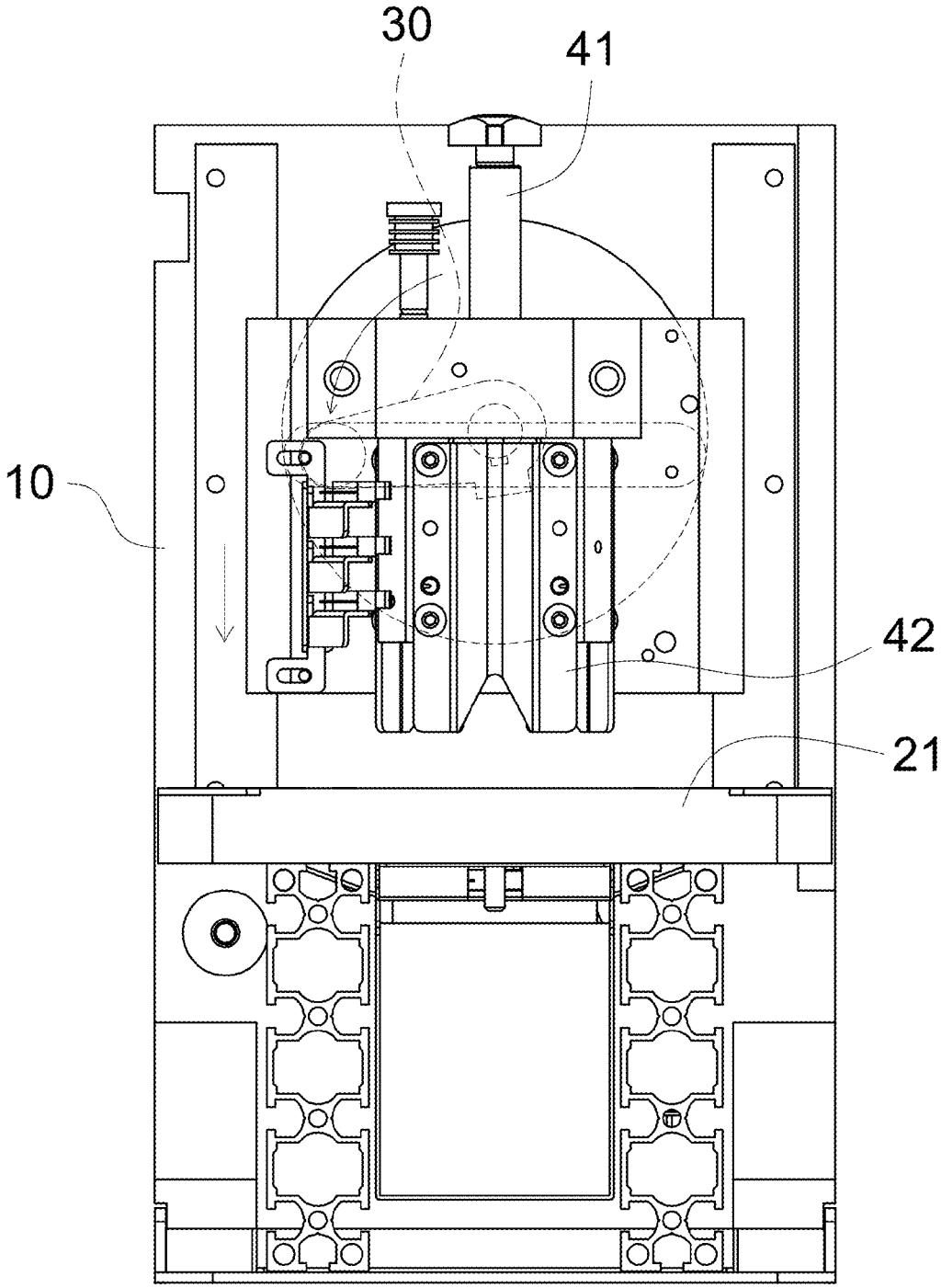
FIG. 11 is another sectional view showing how the powering device provides power to the cutting member in the embodiment of FIG. 1.
Figure 12:
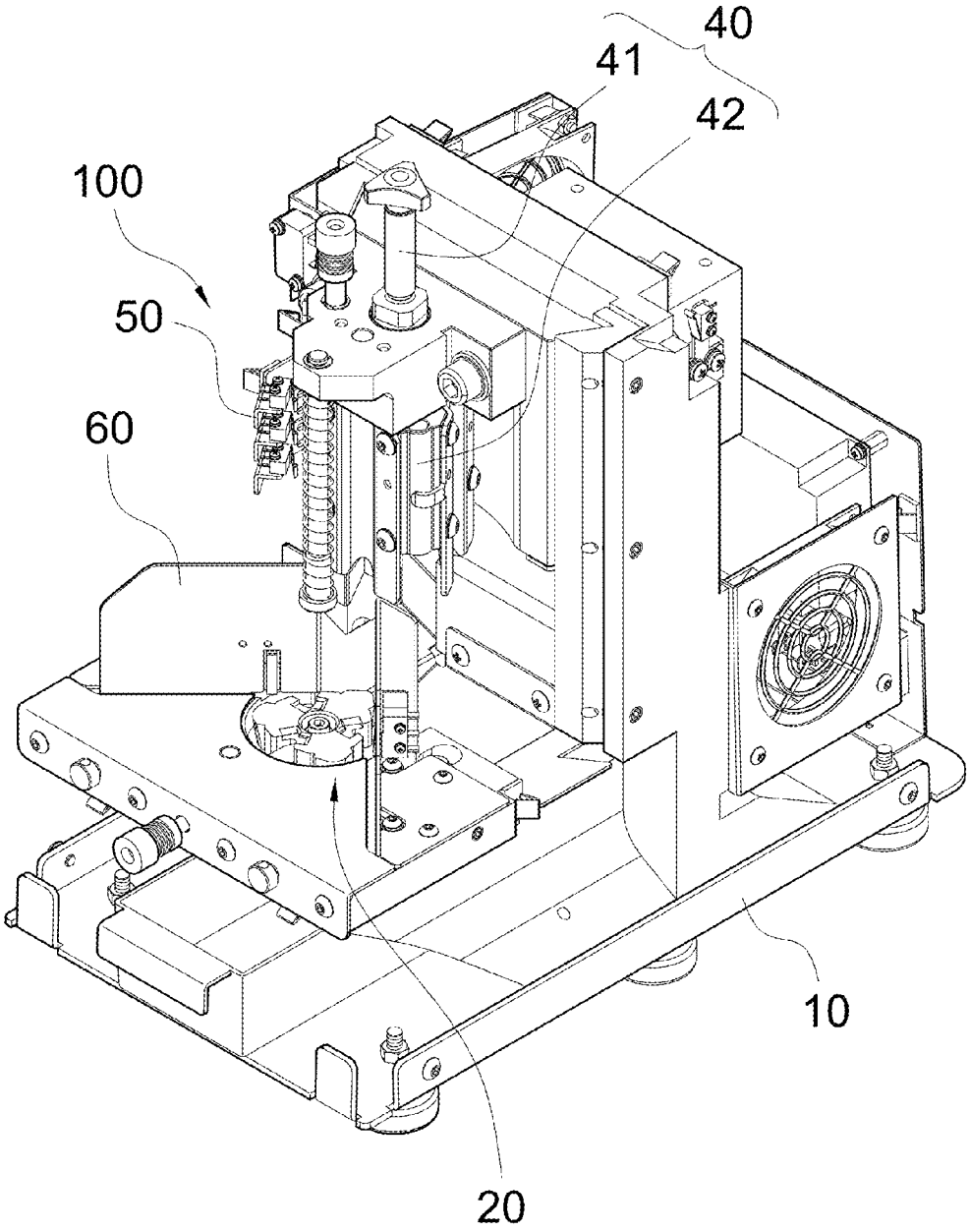
FIG. 12 is a perspective view showing a second embodiment in an assembled condition with the casing removed.
Figure 13:
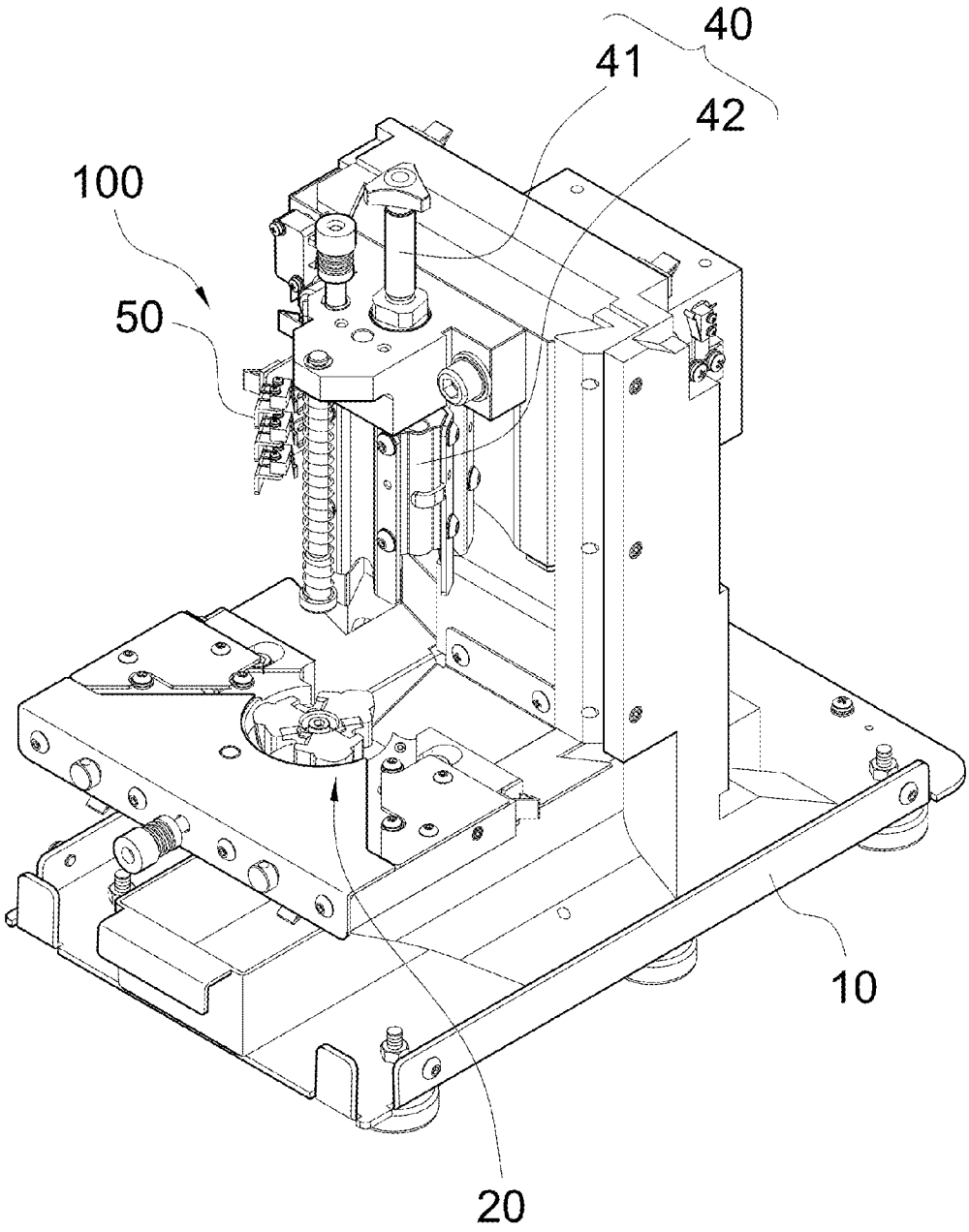
FIG. 13 is a perspective view showing the second embodiment in an assembled condition with the protecting device removed.
Figure 14:
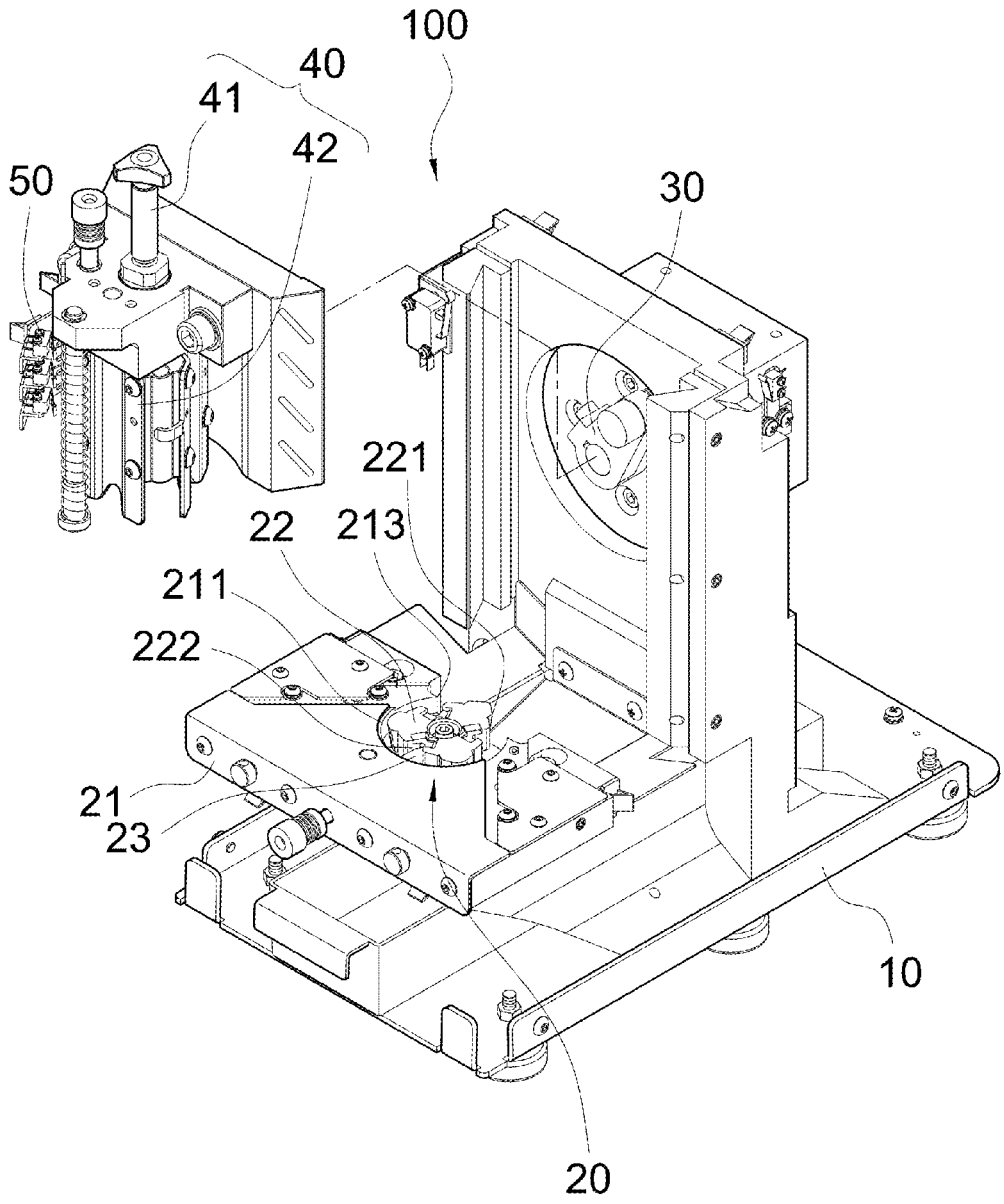
FIG. 14 is a perspective view showing the second embodiment with the cutting device and the positioning device detached.
Figure 15:
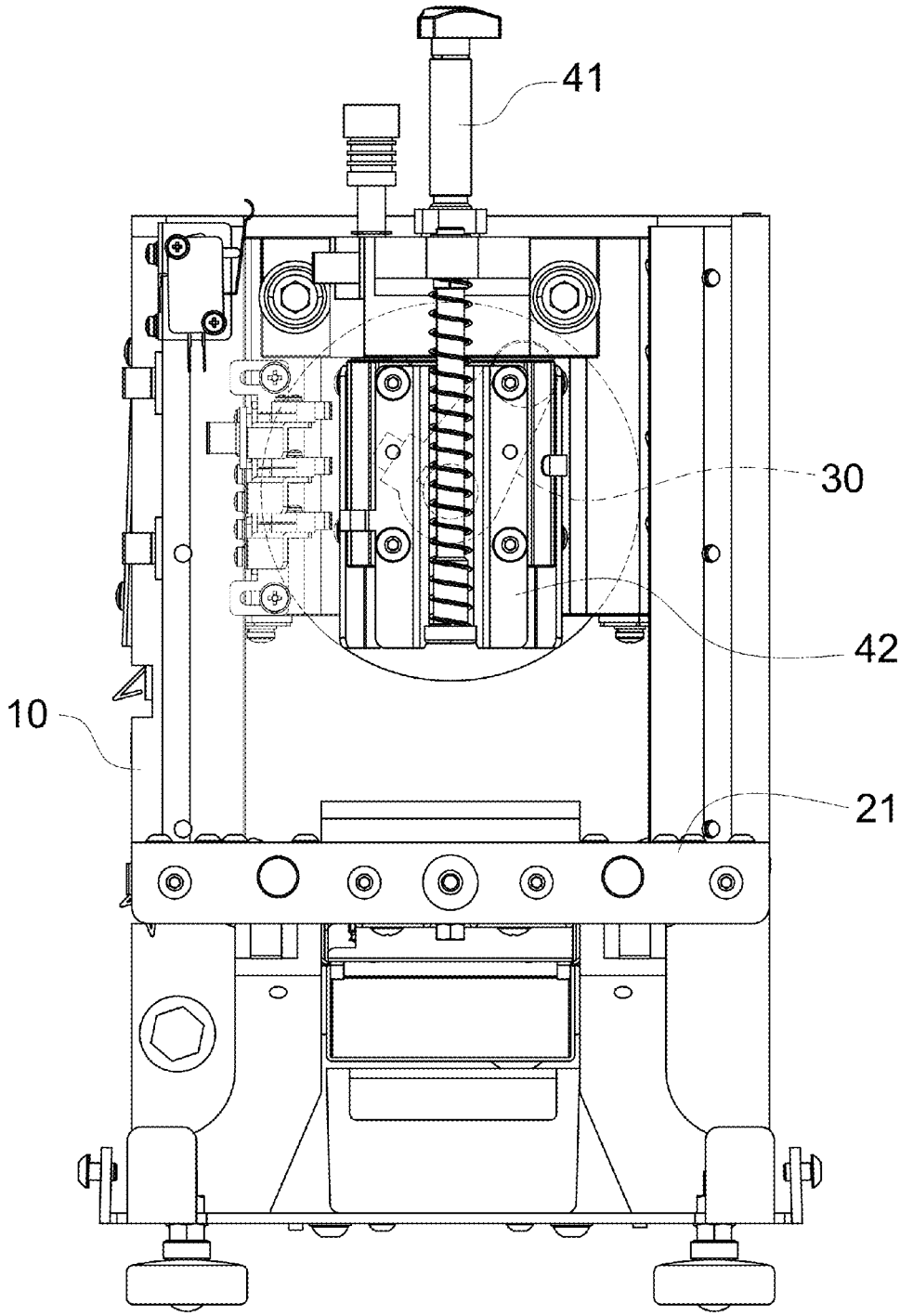
FIG. 15 is a cross-sectional view showing how a cutting member of the second embodiment is switched to another cutting member.
Figure 16:
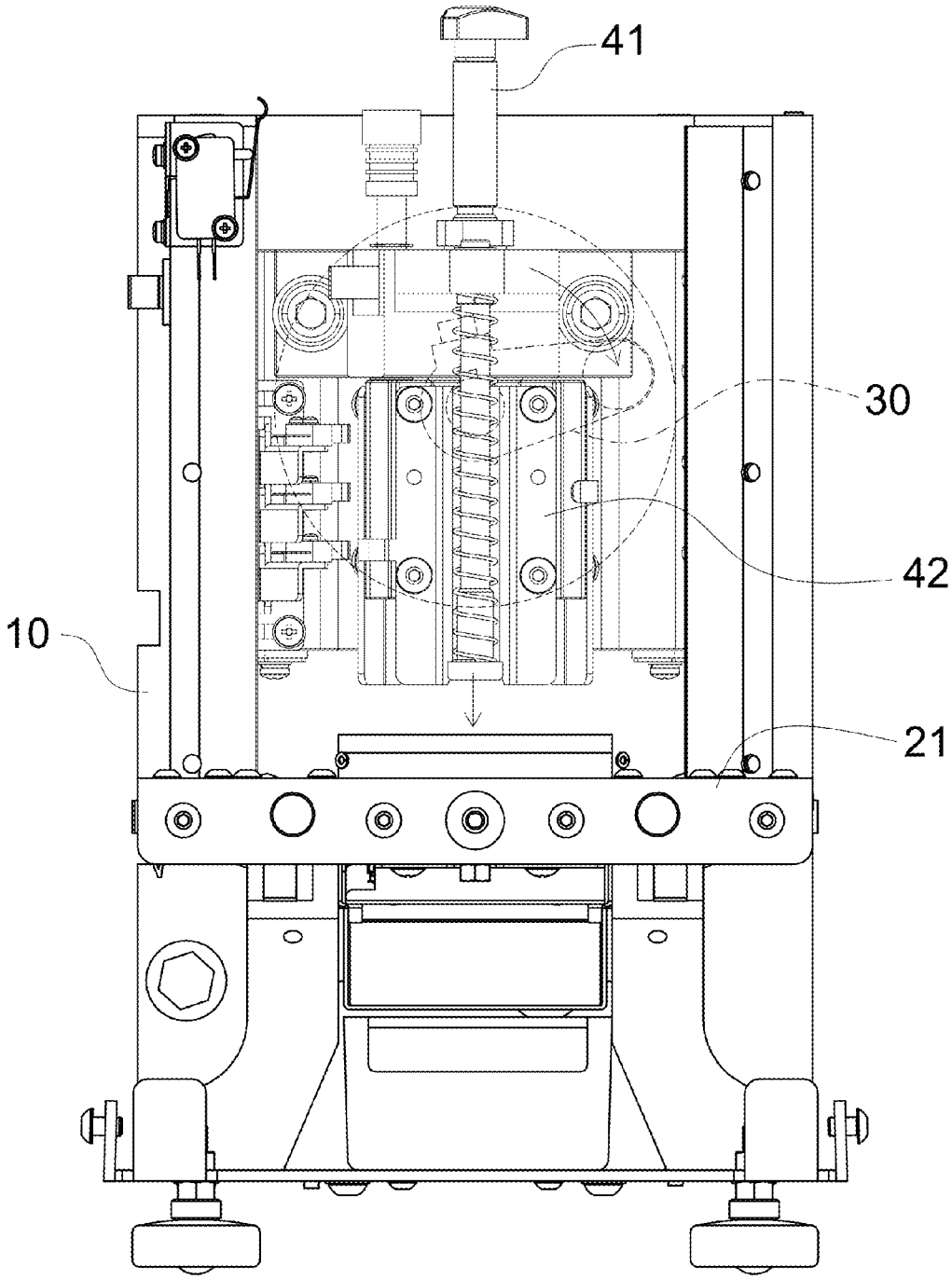
FIG. 16 is a cross-sectional view showing how a cutting member of the second embodiment is switched to another cutting member.

Then, rotate the vertical axle 41 (as shown in FIG. 9) so that the cutting member 42 is lined up with the exterior wall 221. After the cutting member 42 is correctly positioned, the powering device 3 can provide power to the cutting member 42, which would be able to carry out a reciprocating up-down motion to cut paper (as shown in FIGS. 10 and 11).

If the cutting members 42 are not correctly positioned, power generated by the powering device 3 would be blocked and the electricity would be shut off.

Therefore, the angle cutting machine of the present invention can provide cutting members with different shapes and cutting angles to enhance the efficiency and safety in operation.

Though in the preferred embodiment, each of the exterior walls 221 has an inclination that matches the corresponding cutting member 42. Alternatively, each of the exterior walls 221 has an arc shape that matches the corresponding cutting member 42.

Alternatively, the positioning device 50 may comprises a plurality of sensors (whose quantity is equal to that of the cutting members 42), instead of the touch switches. The sensors are disposed on the cutting device 40.

From the above, we can see that the angle cutting machine of the present invention meets the relevant patent requirements. It is hoped that the patent application will be approved.

Many changes and modifications in the above described embodiment of the invention can, of course, be carried out without departing from the scope thereof. Accordingly, to promote the progress in science and the useful arts, the invention is disclosed and is intended to be limited only by the scope of the appended claims.

What is claimed is:

1. An angle cutting machine with exchangeable cutting members, comprising:

a base portion stably rested on a flat surface;

an adjusting device, disposed on the base portion, wherein the adjusting device comprises a base board, an adjusting portion and a position limiting portion, and wherein the base board is fixedly disposed on the base portion and an adjusting area and a position limiting area are formed in the base board, and wherein the position limiting area is in communication with the adjusting area and the adjusting portion is disposed in the adjusting area and can spin around, and wherein several exterior walls and several position limiting slots are provided on the adjusting portion and each of the exterior walls of the adjusting portion has a different inclination or arc shape and the position limiting slots are formed between each pair of the exterior walls, and wherein the position limiting slots and the exterior walls are arranged in an alternating manner, and wherein the position limiting portion is disposed in the position limiting area and can spin around and a position limiting protrusion is provided on the position limiting portion, and wherein as the position limiting protrusion enters the position limiting slot, the adjusting portion would not be able to rotate;

a cutting device, having a vertical axle and a plurality of cutting members, wherein the vertical axle can carry out a reciprocating up-down motion and spin, and wherein the cutting members circumferentially encircle the cutting device;

a powering device, disposed on the base portion, wherein the powering device can provide power to the vertical axle so that the vertical axle can carry out the reciprocating up-down motion; and a positioning device, wherein the positioning device moves along with the cutting device to ensure the correct positioning of the cutting device.

2. The angle cutting machine as in claim 1, wherein the adjusting device further comprises a resistance unit, and wherein the resistance unit is fitted to the underside of the base board and is connected with the adjusting portion and the position limiting portion so as to provide an appropriate amount of resistance to the adjusting portion and the position limiting portion.

3. The angle cutting machine as in claim 1, wherein an opening is formed on one side of the base board and is in communication with the adjusting area so that one of the exterior walls is lined up with the opening.

4. The cutting members as in claim 1, wherein each of the exterior walls of the adjusting portion has a different inclination.

5. The cutting members as in claim 4, wherein each of the cutting members has an inclination equal to that of the corresponding exterior wall of the adjusting portion.

6. The cutting members as in claim 1, wherein each of the exterior walls of the adjusting portion has a different arc shape.

7. The cutting members as in claim 6, wherein the arc shape of each of the cutting members matches that of the corresponding exterior wall.

8. The cutting members as in claim 1, wherein the positioning device comprises a plurality of touch switches, whose quantity is equal to that of the cutting members, and the touch switches are disposed on the base portion.

9. The angle cutting machine as in claim 1, wherein the angle cutting machine further comprises a protecting device, which includes a plurality of protesting boards disposed on the base portion, and wherein the protesting boards can prevent accidental contact between a user's body and the cutting device.

* * * * *